US005625370A

United States Patent [19]

D'Hont

[11] Patent Number: 5,625,370

[45] Date of Patent: Apr. 29, 1997

[54] IDENTIFICATION SYSTEM ANTENNA WITH IMPEDANCE TRANSFORMER

[75] Inventor: Loek J. D'Hont, Almelo, Netherlands

[73] Assignee: Texas Instruments Incorporated, Dallas, Tex.

[21] Appl. No.: 280,104

[22] Filed: Jul. 25, 1994

[51] Int. Cl.[6] ..... H01Q 7/08

[52] U.S. Cl. ..... 343/788; 343/787; 343/742; 340/505; 336/175; 336/223

[58] Field of Search ..... 343/741, 742, 343/856, 866, 787, 788; 340/505, 572; 342/44, 51; 336/200, 205, 186, 192, 225, 232, 226, 213, 219, 217, 175, 223

[56] References Cited

U.S. PATENT DOCUMENTS

| | | | |
|---|---|---|---|
| 2,411,374 | 7/1946 | Horstman | 336/213 |
| 2,955,286 | 10/1960 | Klein | 343/742 |
| 3,546,565 | 12/1970 | Downing, Jr. et al. | 336/175 |
| 3,644,786 | 2/1972 | Yannucci | 336/150 |
| 3,717,876 | 2/1973 | Volkers et al. | 343/788 |
| 3,761,938 | 9/1973 | Reggia | 343/787 |
| 4,155,091 | 5/1979 | Vorie | 343/788 |
| 4,746,891 | 5/1988 | Zylstra | 343/175 |
| 4,873,527 | 10/1989 | Tan | 343/788 |
| 5,053,774 | 10/1991 | Schuermann et al. | 342/44 |
| 5,373,303 | 12/1994 | D'Hont | 340/505 |
| 5,408,243 | 4/1995 | D'Hont | 343/787 |

FOREIGN PATENT DOCUMENTS

| | | | |
|---|---|---|---|
| 0549832A1 | 12/1991 | European Pat. Off. . | |
| 2155461 | 12/1978 | Germany | 343/788 |

OTHER PUBLICATIONS

IBM Technical Disclosure Bulletin, vol. 21, No. 9, Feb. 9, 1979, "Structures Connecting Main Core And Shunt Core In Controlled Transformer", R. G. Brocko and G. C. Feth, pp. 3567–3568.

*Primary Examiner*—Donald T. Hajec
*Assistant Examiner*—Tan Ho
*Attorney, Agent, or Firm*—Ira S. Matsil; James C. Kesterson; Richard L. Donaldson

[57] ABSTRACT

The present invention discloses an electromagnetic device which includes a magnetic flux producing apparatus for producing a magnetic flux path loop. The magnetic flux producing apparatus preferably comprises a magnetic core 20 surrounded by electrical windings 22. A strip of electrically conductive material 24 is disposed such that it passes through the magnetic flux path loop and overlies the windings 22. The strip 24 has a width which is substantially greater than its thickness. The device may further include an antenna 16 which is electrically coupled to the strip 24.

23 Claims, 4 Drawing Sheets

FIG. 4
(PRIOR ART)
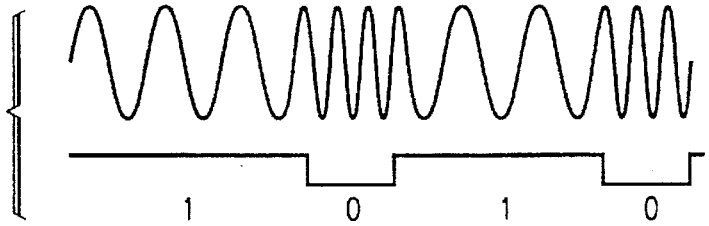
FIG. 5
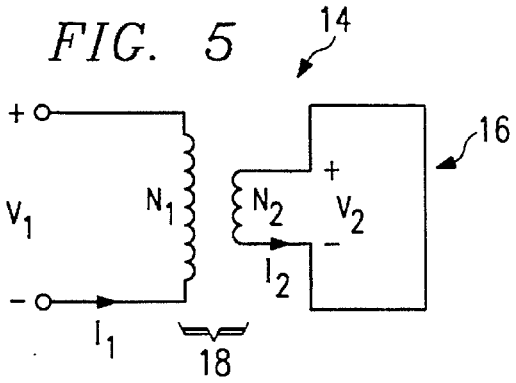
FIG. 6
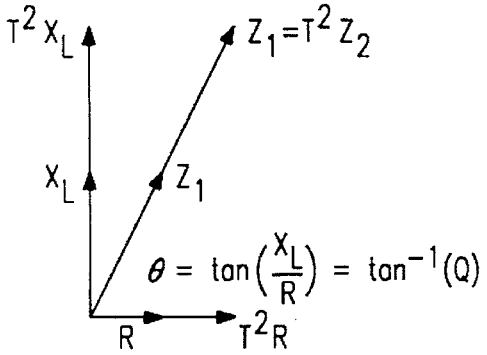
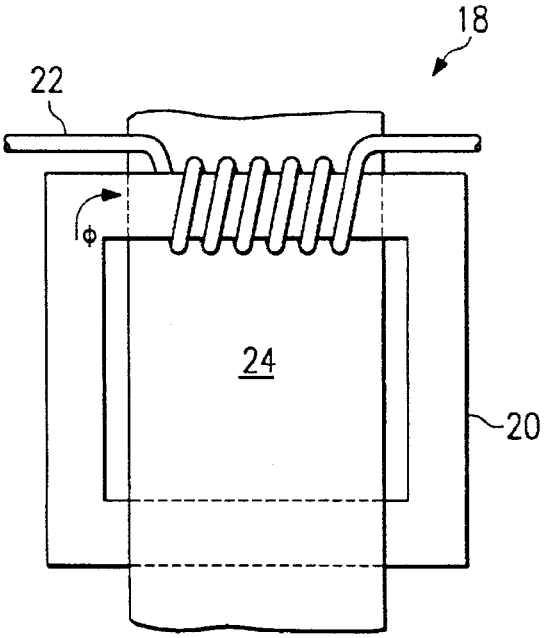
FIG. 7

IDENTIFICATION SYSTEM ANTENNA WITH IMPEDANCE TRANSFORMER

CROSS-REFERENCE TO RELATED APPLICATIONS

The following co-assigned patent and applications are hereby incorporated herein by reference:

| Patent or Serial No. | Effective Filing Date | Issue Date | TI Case No. |
|---|---|---|---|
| 5,053,774 | 07/08/88 | 10/01/91 | TI-12797A |
| 5,450,088 | 11/25/92 | 09/12/95 | TI-16688 |
| 5,491,483 | 01/05/94 | 02/13/96 | TI-18129 |

FIELD OF THE INVENTION

This invention generally relates to identification systems and more specifically to an identification system antenna with an impedance transformer and a method for using the same.

BACKGROUND OF THE INVENTION

There is a great need for devices or apparatuses which make it possible to identify or detect objects in contactless manner and over a certain distance. In addition, a need exists to be able to change the data stored in, or operating characteristics of, these devices or apparatuses (e.g., "program" the devices or apparatuses).

It is, for example, desirable to contactlessly request, over a certain distance, identifications which are uniquely assigned to an object. These identifications could be stored in the device or apparatus so that, for example, the object may be identified. A determination may also be made as to whether or not a particular object exists within a given reading range.

As another example, physical parameters such as temperature or pressure can be interrogated directly even when direct contact to the object is not possible. A device or apparatus of the type desired can, for example, be attached to an animal which can then always be identified at an interrogation point without direct contact. There is also a need for a device which, when carried by a person, permits access checking whereby only persons whose responder unit returns certain identification data to the interrogation unit are allowed access to a specific area. In this case the safeguarding of the data transfer is a very essential factor in the production of such devices.

A further example of a case in which such a device is needed is the computer controlled industrial production in which, without the intervention of operating personnel, components are taken from a store, transported to a production location and there assembled to give a finished product. In this case a device is required which can be attached to the individual components so that the components can be specifically detected in the spares store and taken therefrom.

SUMMARY OF THE INVENTION

Several transponder arrangements have been developed. One such transponder arrangement is described in U.S. Pat. No. 5,053,774 issued on Oct. 1, 1991, incorporated herein by reference. This patent describes a transponder unit which has a low energy requirement and does not need its own power source. Another transponder arrangement is disclosed in co-pending Ser. No. 07/981,635, also incorporated herein by reference.

In one aspect, the present invention provides an improved antenna system for either the reader or transponder of a transponder arrangement. In the preferred embodiment, the antenna is formed from a single loop antenna. This antenna may be made, for example, from a copper strip or copper tubing. The antenna is coupled to an impedance transformer which is used to obtain the desired impedance. The concept can be used for a readout antenna (e.g., low transformation factor) or a transponder antenna (e.g., high transformation factor).

The present invention solves the problem of needing HF LITZ wire for a readout antenna, which is typically in multiple loops carried by a supporting frame (e.g., molded plastic). With the antenna of the present invention, just one loop made from mechanically self-supporting metal tubing, combined with an impedance transformer, can be used to form the antenna.

This configuration provides the advantage of lower antenna cost and a more rigid structure. In addition, the concept provides more degrees of freedom when designing a readout antenna for a specific target inductivity because a specific target antenna impedance (e.g., 27 μH or 116 μH for a reader antenna) can be reached by choosing an antenna frame size and transformer primary-to-secondary winding ratio.

Also, the present approach appears to be the only way to make a real large antenna with sufficient Q to operate as a transponder antenna.

Even more generally, the present invention teaches an electromagnetic device which includes a magnetic core formed in a loop. An electrical winding package surround the magnetic core. A strip of electrically conductive material is disposed such that it passes through the loop and overlies the electrical winding. The strip has a width and a thickness wherein the width is substantially greater than the thickness.

BRIEF DESCRIPTION OF THE DRAWINGS

The above features of the present invention will be more clearly understood from consideration of the following descriptions in connection with accompanying drawings in which:

FIG. 4 illustrates a diagram of the signal levels for a frequency shift keyed signal;

FIG. 5 illustrates a schematic drawing of an antenna system;

FIG. 6 illustrates a phase diagram of the impedance of the transformer of FIG. 5;

FIG. 7 illustrates a first embodiment impedance transformer;

Corresponding numerals and symbols in the different figures refer to corresponding parts unless otherwise indicated.

DETAILED DESCRIPTION OF PREFERRED EMBODIMENTS

The making and use of the presently preferred embodiments are discussed below in detail. However, it should be appreciated that the present invention provides many applicable inventive concepts which can be embodied in a wide variety of specific contexts. The specific embodiments discussed are merely illustrative of specific ways to make and use the invention, and do not limit the scope of the invention.

The following is a description of a system and method of the present invention. A simplified example of one system will first be described. A preferred embodiment antenna will then be briefly described. A novel impedance transformer will next be described in conjunction with FIGS. 7 and 8*a*–8*b*. The integration of the antenna and the impedance transformer will then be described followed by a brief description of just a few of the many applications in which the present invention may be utilized.

The present invention can be utilized with a number of identification systems. A simplified example of just one of these systems will be described with respect to FIG. 1. The details of the electronics of one such system are described in U.S. Pat. No. 5,053,774 (issued Oct. 1, 1991) and incorporated herein by reference. Another transponder arrangement is disclosed in co-pending Ser. No. 07/981,635, now U.S. Pat. No. 5,450,088 also incorporated herein by reference.

Figure 1:
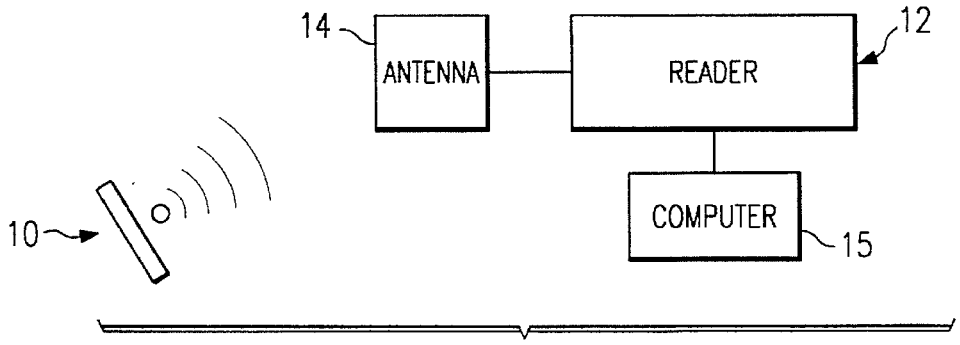
FIG. 1 (PRIOR ART)
FIG. 1 illustrates a generalized block diagram of an identification system.

FIG. 1 has been labeled as prior art because systems, described at this simple level, are known in the art. As will become apparent from the other figures and related discussion, the system of this patent includes novel features which distinguish it from prior art systems.

Referring now to FIG. 1, a transponder 10 is provided. The transponder 10 can be attached to or embedded in (or simply near) an object (not shown). This object can be almost anything imaginable including a tire, baggage, laundry, a trash container, a vehicle, a security badge, or even a living animal. Information stored in the transponder can be accessed by a reader (or interrogation unit) 12. A reader antenna 14 and, optionally, a computer 15 are coupled to the reader 12.

To interrogate the transponder 10, the reader 12 sends out a power burst to the transponder 10 via the antenna 14. In one application, the power burst charges the passive (e.g., battery free) transponder in about 50 milliseconds. The transponder 10 returns a signal that carries the data that is stored within it. In the case of a read only transponder the data is a unique programmed bit code. In read/write applications, the data may comprise the contents of a memory included within the transponder 10 as well. In a typical application, the entire read cycle can be performed in about 70 milliseconds. The data collected from the transponder 10 can either be sent directly to a computer 15 (e.g., through standard interfaces), or it can be stored in a portable reader and later uploaded to a computer or other system.

Figure 2:
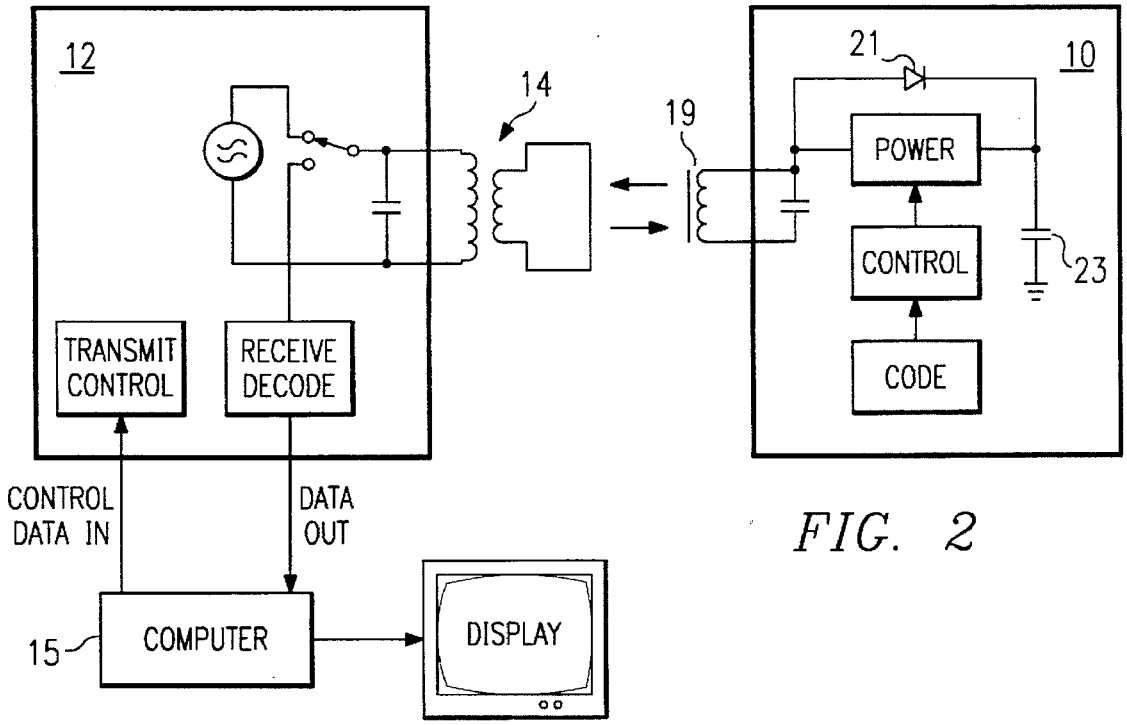
FIG. 2 illustrates a schematic diagram of the present invention which utilizes the system of FIG. 1.
Figure 3:
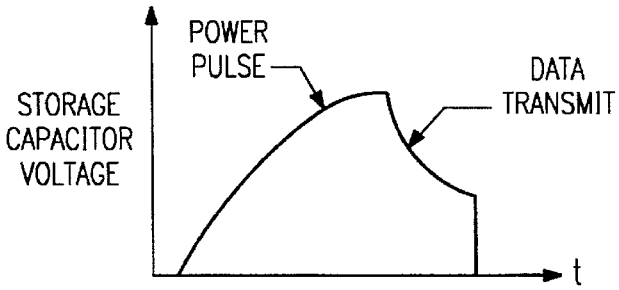
FIG. 3 illustrates a storage capacitor voltage during an interrogation cycle.

The operation of an exemplary system will be described with reference to FIGS. 2–4. Reference should first be made to FIG. 2. When the transponder 10 is to be read, the reader 12 sends out a power pulse to the reader antenna 14. A portion of the electromagnetic field transmitted from reader antenna 14 is "collected" by the transponder antenna 18 coupled to transponder 10. The antennas 14 and 19 are tuned to the same frequency. This collected AC energy is rectified (e.g., by diode 21) and then stored in a capacitor 23 within the transponder 10. Immediately after receiving the power pulse, transponder 10 transmits back its data code, using the energy stored within capacitor 23 as the power source.

This data is received by the reader antenna 14 and decoded by the reader 12. Once all data has been sent, the storage capacitor 23 is discharged thereby resetting the transponder 10 to make it ready for the next read cycle. The period between transmission pulses can be referred to as the "sync time" and will last as long as the system set up. The timing of the storage capacitor voltage is illustrated in FIG. 3.

In the preferred embodiment, the transmission technique used between the transponder 10 and the reader 12 is frequency shift keying (FSK). An FSK signal is illustrated in FIG. 4. This approach has comparatively good resistance to noise while also being very cost effective to implement.

One embodiment of transponder 10 is illustrated in FIG. 2 of the U.S. Pat. No. 5,053,774. This transponder includes an energy accumulator (e.g., capacitor 23 illustrated in FIG. 2 herein) for storing energy contained in the interrogation signal as received by the transponder unit 12. A carrier wave generator provides an FSK modulated carrier wave having at least two frequencies, one of which is the frequency of the interrogation signal. Control signals are produced to maintain and modulate the carrier wave. The FSK modulated carrier wave and data from the transponder unit can then be transmitted back to the antenna of the interrogation unit. This signal can be referred to as the signal information. In addition, the circuit includes circuitry for initiating operation of the carrier wave generator. This initiation occurs in response to a decrease in the detected power level of the RF interrogation signal and the presence of a predetermined energy amount stored in the energy accumulator.

Although the present invention can be utilized with any number of systems, the identification system described herein overcomes some of the limitations of other systems because it does not require line-of-sight between the transponder and the reader. This means that the system can work effectively in environments with excessive dirt, dust, moisture, and poor visibility. In addition, because it can be designed to work at relatively low frequencies, the system can also work through most nonmetallic materials.

In one aspect, the present invention deals with an improved antenna 14 and which includes a corresponding impedance transformer as illustrated in FIG. 5. In the preferred embodiment, a single loop antenna 16 is coupled to transformer 18. The single loop antenna 16 may be made from a copper tube or a copper strip as will be discussed hereinafter. The transformer 18 will preferably comprise a ferrite transformer 18 which will be used to up transform the impedance to the desired inductivity, which is typically higher than the single copper loop has as a basic inductivity. In other applications, the transformer 18 can be used to down transform the impedance.

The transformer 18 itself has a transformation ratio for the impedance which has a value of the windings of the primary to the windings of the secondary taken to the second power. So, for example, a transformer having one winding on the antenna side and five windings on the reader side, would have a winding ratio of five and therefore a transformation ratio of twenty-five. This means that a copper frame having an inductance of about 2 μH would have an inductance on the primary side of about 50 μH. The Q of the antenna 14 stays the same when the transformer 18 has no losses since the imaginary component and real component of the loop antenna 16 are transformed in the same amount. The Q is, in general, defined as a ratio between the imaginary and real components. After a transformation without losses, this ratio, and therefore the Q, stay the same. The following equations summarize the transformation:

(1) Transformation Factor for Impedance=$(N_1/N_2)^2=T^2$ (2) Transformation Factor for Current=$(N_1/N_2)=T$ (3) Transformation Factor for Voltage=$(N_2/N_1)=1/T$ (4) Q of Loop=$X_L/R$ (5) Q on Primary Side=$(T^2 \cdot X_L)/(T^2 \cdot R)$=Q of Loop In the above equations, $N_1$ is the number of turns on the primary side, $N_2$ is the number of turns on the secondary side, $X_L$ is the imaginary component of the impedance and R is the real component of the impedance. FIG. 6 presents a phase diagram which graphically illustrates the fact that the Q is not affected by the transformer. As noted above, the Q is the ratio of the imaginary impedance component $X_L$ to the real component R or the tangent of the angle labeled θ in FIG. 6. Since the transformer causes both $X_L$ and R to increase by the same proportion (namely, $T^2$) the Q is unaffected by the transformer.

Referring now to FIG. 7, a first embodiment of the transformer 18 is illustrated. The transformer 18 comprises a magnetic core 20, a first electrical winding package 22, and a conductive strip 24. In this case, the magnetic core 20 comprises a ring core which preferably formed from a ferrite material. The electrical winding package 22 preferably comprises a metal wire which encircles the magnetic core for a plurality of turns. In this example, the winding package 22 has five turns. The winding package 22 is typically electrically insulated from the core 20.

In the preferred embodiment, the electrical winding package 22 is formed from litze wire. LITZ wire is used for medium to high frequency applications to lower losses in the conductor that would normally occur caused by the skin effect. (The skin effect is an effect where current only flows at the surface of the conductor at high frequencies instead of through the whole cross section of a conductor as is the case with a DC current.) LITZ wire is composed of a bundle of thin, individually insulated conductors that are all in parallel. In this way, the active surface of the conductor that carries the current is increased and therefore losses lowered when using this wire at high frequencies.

The conductive strip 24 preferably comprises a single copper strip. The strip 24 has a width which is substantially greater than its thickness. In a typical embodiment, the strip will be between about one and two inches wide, and between about 0.2 and 1.0 mm thick, preferably about 0.5 mm thick). The width of the strip 24 should be designed to have a width slightly smaller than the width of the flux loop path within the core 20.

As illustrated in FIG. 7, the strip 24 overlies the winding package 22. This feature provides an advantage because the transformation ratios of transformer 18 are more stable in this configuration. It has been discovered that the transformation ratios will not vary as the windings within winding package 22 are shifted back and forth along the member of core 20. Also the windings can be compressed together or spread farther apart without affecting the transformation ratio. In other words, the impedance of the transformer will not be affected by movement of the primary windings 22. This stability is very useful when precise systems are being fabricated in mass production.

In operation, an electrical current within winding package 22 will produce a magnetic flux ϕ within the magnetic core 20. The magnetic flux ϕ will be directed within the core 20 in a flux path loop as illustrated in FIG. 7. The strip of electrically conductive material package 22 is disposed such that it passes through this magnetic flux loop 26. In this manner, the winding package 22 and magnetic core 20 serve as a magnetic flux producing apparatus. An electrical current will be induced within the strip 24 due to the magnetic flux.

Because of the novel configuration of the transformer described herein, the electrical current which is induced in the strip 24 can include any frequency components which the magnetic core can handle. In applications which use the transponder arrangement as described in the U.S. Pat. No. '774, the magnetic core is chosen so as to operate between about 100 and 160 kHz (since the transponder works at about 140 kHz).

Figure 8A:
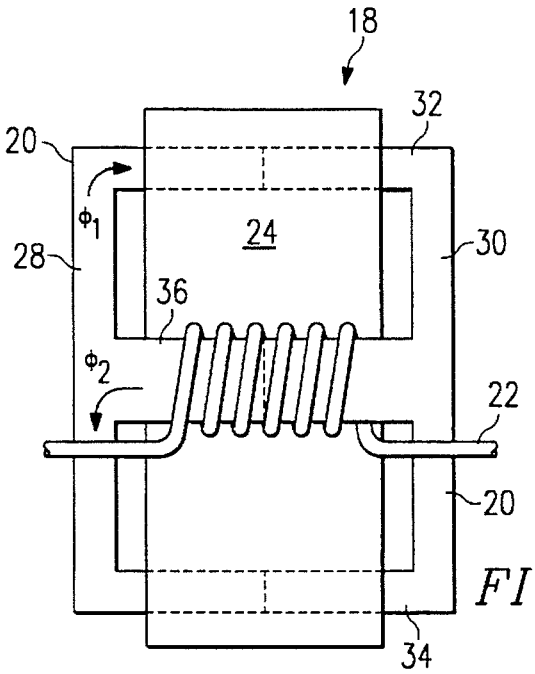
FIG. 8*a* and 8*b* illustrate a preferred embodiment impedance transformer.
Figure 8B:
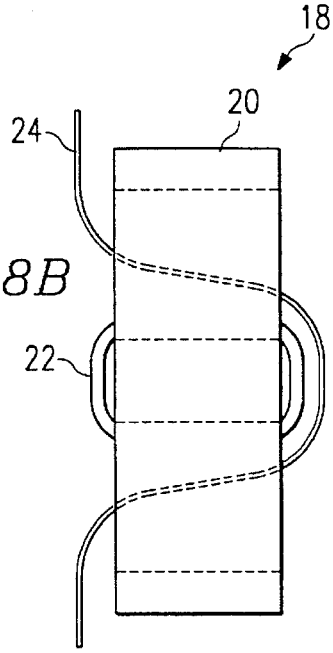

An even more efficient impedance transformer 18 is illustrated in FIGS. 8*a* and 8*b*. In this embodiment, the magnetic core 20 comprises two side members 28 and 30 which are laterally spaced in a first direction. The side members 28 and 30 are physically and magnetically connected at one end by a laterally extending member 32 and at the other end by a laterally extending member 34. The side members 28 and 30 are also connected by a central laterally extending member 36 which is disposed between the laterally extending members 32 and 34. In this embodiment, the electrical winding package 22 surrounds the central laterally extending member 36.

In the embodiment of FIG. 8*a*, two magnetic flux path loops are defined. The two magnetic flux path loops are denoted by $\phi_1$ and $\phi_2$. The first path extends from the central laterally extending member 36 up through the side member 28 to the top laterally extending member 32 and then back to the central laterally extending member 36 via side member 30. Likewise, the first path extends from the central laterally extending member 36 up through the side member 28 to the bottom laterally extending member 34 and then back to the central laterally extending member 36 via side member 30. The strip of electrically conductive material 24 is disposed such that it passes within both of the magnetic flux loop paths $\phi_1$ and $\phi_2$.

In the preferred embodiment, the magnetic core 20 is formed from two abutting E cores. An E core is a specific magnetic core shape in the form of an E. These cores are typically made from ferrite. In embodiments which require higher frequency operation, cores made from sintered iron powder can also be used. Two of the E cores are placed against each other to form two closed, parallel magnetic circuits as illustrated in FIG. 8*a*. It is desirable that there be no gap between the two E cores after they are placed against each other.

As before, the copper strip 24 embraces (i.e., overlies) the primary windings 22. In this way, the impact of movement of the primary windings 22 on the overall activity of the system is minimal and determined only by the size of the copper frame 24. This makes the concept more suitable for mass production.

Figure 9A:
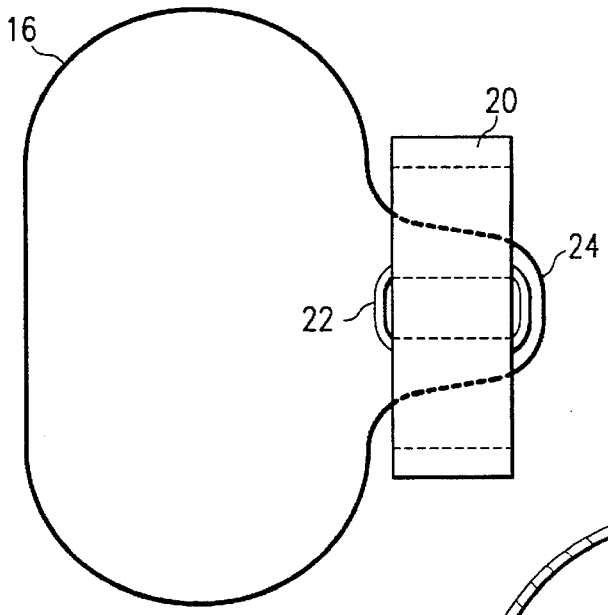
FIGS. 9*a* and 9*b* illustrate two possible methods of integrating an antenna with the impedance transformer of FIG. 8*a;*

The impedance transformer 18 described with respect to FIGS. 8*a* and 8*b* can be integrated with an antenna 16 as illustrated in FIG. 9*a*. In the preferred embodiment, the antenna 16 comprises a single loop antenna. However, it should also be noted that other multi-loop antennas may also be utilized. The loop antenna 16 may comprise a copper strip which is integral with the copper strip 24 which serves as the secondary winding of the transformer 18.

Figure 9B:
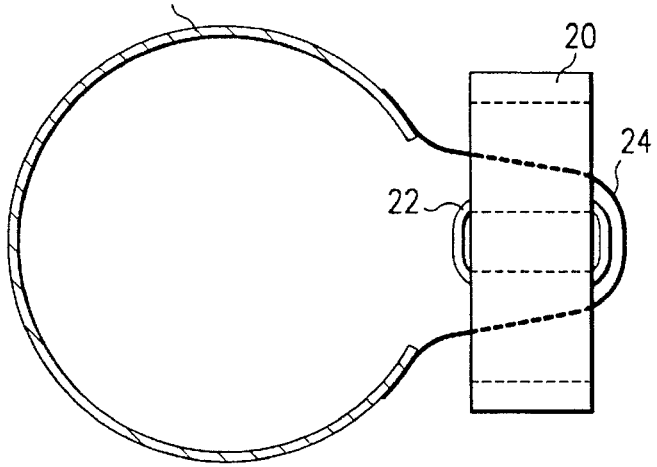

In an alternate embodiment, illustrated in FIG. 9*b*, the antenna comprises a tubular electrically conductive antenna 16. The use of a hollow tube as a conductor (e.g., like copper used in plumbing) is a method to transport RF current instead of the use of LITZ wire. Since the tubing also has a large relative surface area (on which the RF current flows), the resistance for RF current travelling within the tubing is the same as a solid wire of the same diameter. The inner core, which would not carry current at high frequencies anyway, is hollow thereby lowering cost and weight. As opposed to a metal strip and litze wire, the tube has the advantage that it is mechanically self-supporting. The tube 16 may be attached to the strip 24 by welding or soldering or any other mechanically stable an electrically conductive method.

In an alternate embodiment (not illustrated), the tube 16 can form a full loop which is disposed within the flux loop paths of the magnetic core 20. The portion of the tube 16 which is disposed within the core 20 can be compressed down to form a narrow strip. In other words, in this embodiment the conductive strip 24 comprises a flattened portion of tube 16.

Figure 10:
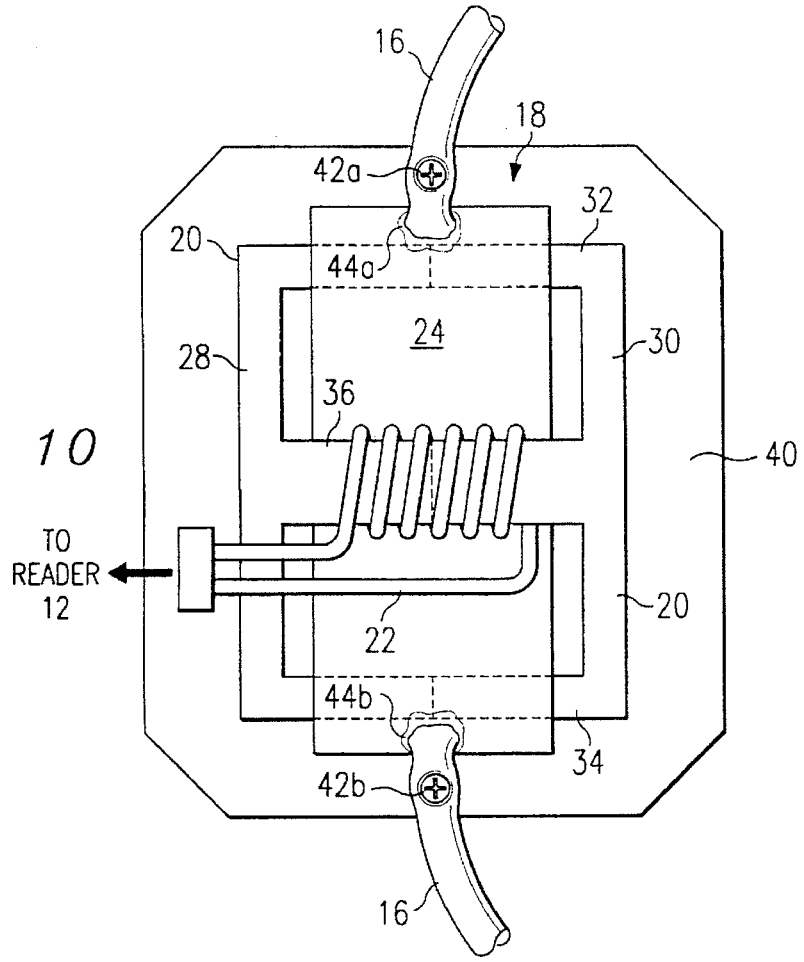
FIG. 10 illustrates an impedance transformer and antenna affixed to a housing.

FIG. 10 illustrates one embodiment of mounting the transformer 18 on a housing 40. The housing 40 may, for example, comprise a plastic housing which is mounted on convenient surface near the reader 12 (or transponder 10 in embodiments like that in FIG. 11 ). The magnetic core 20 may be affixed to the housing 40 in any appropriate manner such as glue or other adhesives.

In this example, the antenna 16 is fastened to the housing 40 with screws 42*a* and 42*b*. Any manner of connection which ensures the physical integrity of the system may be used. In this embodiment, the antenna 16 is also welded to the conductive strip 24 as noted by regions 44*a* and 44*b*. Once again, any manner of connection can be utilized so long as the electrical resistance between the antenna 16 and strip 24 is kept to a minimum and the physical integrity of the system is not jeopardized.

The electrical winding package 22 is coupled to an electrical connector 46 which can then lead to the appropriate circuitry within the system. In the system of FIG. 2, electrical connector 46 is coupled to the reader 12. On the other hand, in the system of FIG. 11, electrical connector 46 would be coupled to the transponder 10 circuitry. In other systems, the winding package 22 may be coupled to other circuitry.

In embodiments discussed thus far, the secondary winding 24 is coupled to the antenna 16 while the primary winding package 22 is coupled to the reader circuitry as illustrated in FIG. 2. In an alternative embodiment illustrated in FIG. 11, the antenna 16 can be used as the transponder antenna 19. In this case, the metal strip 24 will serve as the primary winding while the electrical windings within winding package 22 will serve as the secondary windings. The secondary winding package 22 will then be coupled to the transponder circuitry 10.

This embodiment will preferably be used as a transponder antenna in applications where the transponder is affixed to an immobile object or other applications where a physically larger antenna can be tolerated. This embodiment is useful in applications which require larger read ranges. One example, for waste bins and yachts, is disclosed in co-pending application Ser. No. 08/177,510, now U.S. Pat. No. 5,491,483.

Figure 11:
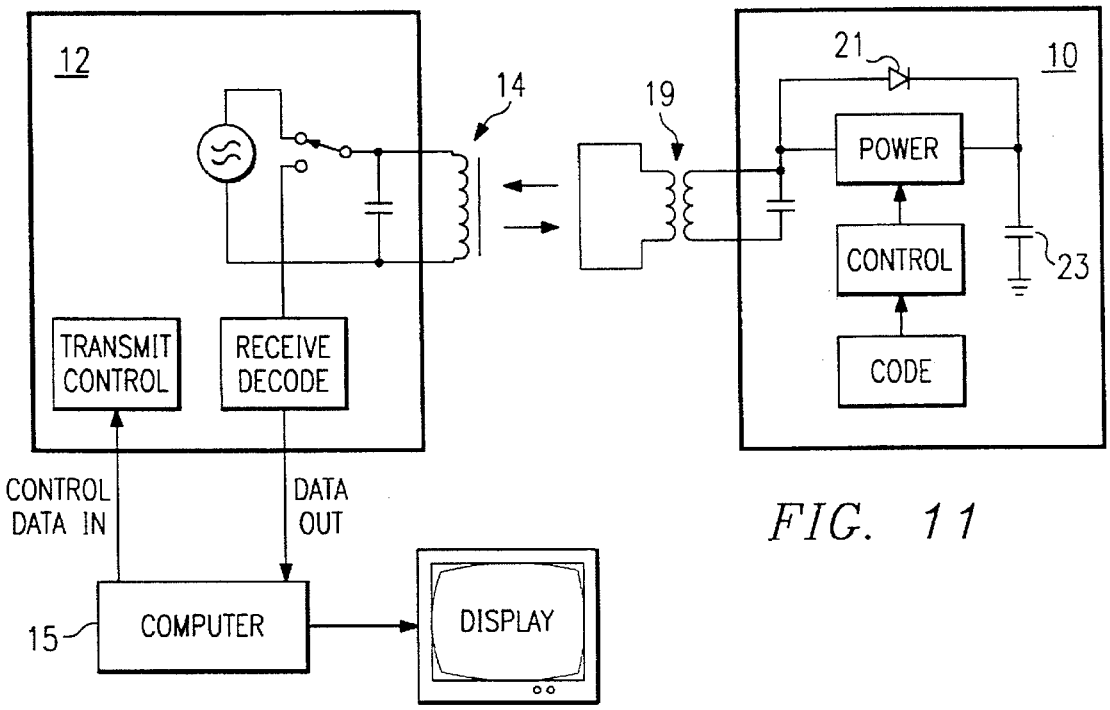
FIG. 11 illustrates a schematic diagram of an alternate embodiment identification system.

It should also be noted that the antenna system of the present invention can be utilized for both the transponder antenna 19 (as shown in FIG. 11) and the reader antenna 14 (as shown in FIG. 2).

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An electromagnetic device comprising:

a magnetic core formed in a first loop and a second loop;

an electrical winding package surrounding said magnetic core; and a strip of electrically conductive material disposed such that said strip passes through both said first loop and said second loop and overlies said electrical winding package, said strip having a width and a thickness wherein said width is substantially greater than said thickness, said strip also having a first end and a second end.

2. The device of claim 1 wherein said magnetic core comprises a ring core.

3. The device of claim 1 wherein said magnetic core comprises two E cores abutting each other so as to define two magnetic flux path loops.

4. The device of claim 1 wherein said magnetic core comprises a ferrite core.

5. The device of claim 1 wherein said electrical winding package comprises a metal wire which encircles said magnetic core for a plurality of turns.

6. The device of claim 5:

wherein said metal wire comprises a bundle of individually insulated conductors.

7. The device of claim 1 wherein said strip comprises a copper strip.

8. The device of claim 1 and further comprising an antenna with a first end and a second end, wherein said first end of said antenna is electrically coupled to said first end of said strip and said second end of said antenna is electrically coupled to said second end of said strip.

9. The device of claim 8 wherein said antenna comprises a single loop antenna.

10. The device of claim 9 wherein said antenna comprises copper tubing.

11. An impedance transformer comprising:

a magnetic core including two side-members laterally spaced in a first direction, said side-members connected by a laterally extending member, said magnetic core defining at least two magnetic flux path loops;

an electrical winding surrounding a portion of said laterally extending member and operable to produce a magnetic flux along said magnetic flux path loop; and a strip of electrically conductive material disposed such that said strip passes through said two magnetic flux path loops and over said electrical winding, said strip having a width and a thickness wherein said width is substantially greater than said thickness.

12. The device of claim 11 wherein said magnetic core comprises a ferrite core.

13. The device of claim 12 wherein said strip comprises a copper strip.

14. An impedance transformer comprising:

a magnetic core comprising two side-members laterally spaced in a first direction, said side-members each having first and second ends, said side-members connected by a top laterally extending member at said first ends, a bottom laterally extending member at said second ends and a central laterally extending member disposed between said top and bottom laterally extending members;

an electrical winding surrounding said central laterally extending member; and a strip of electrically conductive material disposed such that said strip passes between said top and central laterally extending members and also between said bottom and central laterally extending members, said strip having a width and a thickness wherein said width is substantially greater than said thickness.

15. An antenna including an impedance transformer comprising:

a magnetic core formed in a loop;

an electrical winding surrounding said magnetic core;

a strip of electrically conductive material disposed such that said strip passes through said loop and overlies said electrical winding, said strip having a width and a thickness wherein said width is substantially greater than said thickness, said strip also having a first end and a second end; and an antenna formed from a single loop electrical conductor, said antenna coupled to said strip; wherein:

said magnetic core includes two side-members laterally spaced in a first direction, said side-members each having first and second ends, said side-members connected by a top laterally extending member at said first ends, a bottom laterally extending member at said second ends and a central laterally extending member disposed between said top and bottom laterally extending members:

said electrical winding surrounds said central laterally extending member; and said strip passes between said top and central laterally extending members and also between said bottom and central laterally extending members.

16. The antenna of claim 15 wherein:

said antenna is formed from a copper material;

said strip comprises a copper strip; and said core comprises a ferrite core.

17. The antenna of claim 16 wherein said antenna comprises a copper tube.

18. An identification system comprising:

an interrogation unit for communicating with cooperating transponder units, said interrogation unit comprising:

an interrogation signal generator;

an electrical conductor coupled to said interrogation signal generator;

a magnetic core formed in a first loop and a second loop wherein said electrical conductor winds around a portion of said magnetic core which is common to said first and second loops;

a strip of electrically conductive material disposed such that said strip passes through said first loop and said second loop and said strip overlies said electrical conductor, said strip having a width and a thickness wherein said width is substantially greater than said thickness; and an antenna coupled to said strip, said antenna for transmitting an interrogation signal generated by said interrogation signal generator; and a transponder unit located in spaced relation with respect to said interrogation unit for receiving said interrogation signal and returning signal information in response to said interrogation signal.

19. The system of claim 18 wherein:

said magnetic core includes two side-members laterally spaced in a first direction, said side-members each having first and second ends, said side-members connected by a top laterally extending member at said first ends, a bottom laterally extending member at said second ends and a central laterally extending member disposed between said top and bottom laterally extending members;

said electrical conductor surrounds said central laterally extending member; and said strip passes between said top and central laterally extending members and also between said bottom and central laterally extending members.

20. The system of claim 19 wherein:

said antenna is formed from a copper material;

said strip comprises a copper strip; and said core comprises a ferrite core.

21. The system of claim 20 wherein said antenna comprises a copper tube.

22. The system of claim 18 wherein said transponder unit comprises:

an energy accumulator for storing energy contained in said interrogation signal as received by said transponder unit;

a carrier wave generator operable for providing a FSK modulated carrier wave having at least two frequencies, one of said two frequencies being a first frequency contained in said interrogation signal and a second frequency selectively shifted from said first frequency;

circuitry operably connected to the output of said carrier wave generator for producing control signals for maintaining and modulating said carrier wave;

circuitry for transmitting the FSK modulated carrier wave and data from said transponder unit back to the antenna of said interrogation unit as said signal information; and circuitry for initiating operation of said carrier wave generator in response to the detected power level of the RF interrogation signal decreasing and the presence of a predetermined energy amount stored in said energy accumulator.

23. An identification system comprising:

an interrogation unit for communicating with cooperating transponder units, said interrogation unit comprising:

control circuitry;

a transmitter for transmission of at least one interrogation signal, said transmitter coupled to said control circuitry; and a receiver for receiving signal information at the termination of said interrogation signal, said receiver coupled to said control circuitry; and a transponder unit located in spaced relation with respect to said interrogation unit for receiving said interrogation signal and returning signal information to said receiver, said transponder unit including:

internal transponder circuitry;

an electrical conductor coupled to said internal transponder circuitry;

a magnetic core formed in a first loop and a second loop wherein said electrical conductor winds around a portion of said magnetic are which is common to said first and second loops;

a strip of electrically conductive material disposed such that said strip passes through said first and second loops and overlies said electrical winding, said strip having a width and a thickness wherein said width is substantially greater than said thickness; and an antenna coupled to said strip, said antenna for receiving said interrogation signal from said interrogation unit.

* * * * *